US010787927B2

(12) United States Patent
Krewinkel

(10) Patent No.: US 10,787,927 B2
(45) Date of Patent: Sep. 29, 2020

(54) GAS TURBINE ENGINE HAVING A FLOW-CONDUCTING ASSEMBLY FORMED OF NOZZLES TO DIRECT A COOLING MEDIUM ONTO A SURFACE

(71) Applicant: MAN Energy Solutions SE, Augsburg (DE)

(72) Inventor: Robert Krewinkel, Gelsenkirchen (DE)

(73) Assignee: MAN Energy Solutions SE, Augsburg (DE)

( * ) Notice: Subject to any disclaimer, the term of this patent is extended or adjusted under 35 U.S.C. 154(b) by 155 days.

(21) Appl. No.: 16/136,313

(22) Filed: Sep. 20, 2018

(65) Prior Publication Data

US 2019/0128138 A1 May 2, 2019

(30) Foreign Application Priority Data

Oct. 26, 2017 (DE) ..... 10 2017 125 051

(51) Int. Cl.

| | |
|---|---|
| ***F23R 3/04*** | (2006.01) |
| ***F01D 25/12*** | (2006.01) |
| ***F23R 3/00*** | (2006.01) |
| ***F01D 9/06*** | (2006.01) |
| *F01D 9/04* | (2006.01) |
| *F01D 5/18* | (2006.01) |
| *F23R 3/06* | (2006.01) |

(52) U.S. Cl.

CPC ..... *F01D 25/12* (2013.01); *F01D 9/065* (2013.01); *F23R 3/002* (2013.01); *F01D 5/187* (2013.01); *F01D 9/04* (2013.01); *F05D 2250/141* (2013.01); *F05D 2260/201* (2013.01); *F23R 3/045* (2013.01); *F23R 3/06* (2013.01); *F23R 2900/03044* (2013.01)

(58) Field of Classification Search

CPC .. F23R 3/045; F23R 3/06; F23R 3/002; F23R 3/16; F23R 2900/03041; F23R 2900/03042; F23R 2900/03043; F23R 2900/03044; F01D 25/12; F01D 9/04; F01D 5/187

See application file for complete search history.

(56) References Cited

U.S. PATENT DOCUMENTS 4,301,657 A * 11/1981 Penny ..... F23R 3/12 60/748
4,590,769 A * 5/1986 Lohmann ..... F23R 3/045 60/752

(Continued)

*Primary Examiner* — William H Rodriguez
(74) *Attorney, Agent, or Firm* — Cozen O'Connor

(57) ABSTRACT

A turbomachine, with a flow-conducting assembly, which on a first side serves for the flow-conduction of a first medium, which has a first temperature, and which on a second side is coolable with a second medium, which has a second temperature, that is lower than the first temperature, and with an impingement grille including openings which extend spaced from the flow-conducting assembly, wherein via the openings of the impingement grille the second medium is directable onto the second side of the flow-conducting assembly. In the region of at least some of the openings of the impingement grille, flow-conducting elements for the second medium are formed, which emanating from the impingement grille extend in the direction of the second side of the flow-conducting assembly to be cooled.

17 Claims, 2 Drawing Sheets

(56) References Cited

U.S. PATENT DOCUMENTS 5,027,603 A * 7/1991 Shekleton ..... F02C 7/26 60/39.826
5,063,745 A * 11/1991 Shekleton ..... F23D 11/005 60/737
5,123,248 A * 6/1992 Monty ..... F23C 7/002 60/740
5,205,117 A * 4/1993 Shekleton ..... F23R 3/002 60/778
5,220,794 A * 6/1993 Sledd ..... F23C 5/00 60/737
5,261,224 A * 11/1993 Shekleton ..... F23R 3/002 60/738
5,263,316 A * 11/1993 Shekleton ..... F02G 1/00 60/743
5,277,022 A * 1/1994 Shekleton ..... F23R 3/54 60/737
5,303,543 A * 4/1994 Shah ..... F01D 9/023 60/804
5,317,864 A * 6/1994 Shorb ..... F23R 3/28 60/740
5,488,829 A * 2/1996 Southall ..... F23R 3/12 60/725
5,533,864 A * 7/1996 Nomoto ..... F01D 5/186 415/115
5,687,572 A * 11/1997 Schrantz ..... F23R 3/007 431/352
6,351,949 B1 * 3/2002 Rice ..... F23R 3/007 403/316
6,484,505 B1 * 11/2002 Brown ..... F23R 3/002 60/760
8,281,600 B2 * 10/2012 Chen ..... F02C 7/18 60/772
8,291,711 B2 * 10/2012 Chokshi ..... F23R 3/06 60/758
9,046,269 B2 * 6/2015 Smith ..... F01D 5/186
2004/0003599 A1 * 1/2004 Ingram ..... F23R 3/50 60/804
2004/0213664 A1 * 10/2004 Wilusz ..... F01D 11/24 415/116
2004/0216463 A1 * 11/2004 Harris ..... F23R 3/045 60/776
2009/0255268 A1 * 10/2009 Kaleeswaran ..... F23R 3/002 60/757
2010/0126174 A1 5/2010 Brinkmann
2016/0281987 A1 * 9/2016 Torkaman ..... F23R 3/06
2017/0176006 A1 * 6/2017 Gerendas ..... F23R 3/06
2018/0238547 A1 * 8/2018 Quach ..... F23R 3/06
2019/0017440 A1 * 1/2019 Porter ..... F02C 3/04

* cited by examiner

GAS TURBINE ENGINE HAVING A FLOW-CONDUCTING ASSEMBLY FORMED OF NOZZLES TO DIRECT A COOLING MEDIUM ONTO A SURFACE

FIELD OF THE INVENTION

The present invention relates to the cooling of a flow-connecting assembly of a turbomachine.

BACKGROUND OF THE INVENTION

Turbomachines, such as for example gas turbines, turbines or compressors, comprise flow-conducting assemblies which on a first side serve for the flow conduction of a first medium, which has a first temperature.

In particular in the case of turbines and in the case of gas turbines in the region of a turbine or of a combustion chamber of the gas turbine, the first medium, which is conducted on the first side of the flow-conducting assembly, has a very high temperature that makes it necessary to cool the flow-conducting assembly. Here it is already known from the prior art to cool the flow-conducting assembly on a second side using a second medium, which has a temperature that is lower than the first temperature.

Accordingly, US2010/0126174 discloses a gas turbine with a combustion chamber, wherein a wall of the combustion chamber inside on a first side serves for the flow conduction of the fuel flow. On a second side, the wall of the combustion chamber is cooled via an impingement cooling, wherein for this purpose spaced from the wall of the combustion chamber to be cooled, an impingement grille extends, which comprises openings. By way of the openings of the impingement grille, the second medium is conductable or guidable onto the second side of the flow-conducting assembly, namely the wall of the combustion chamber, in order to cool the same.

From US2010/0126174 it is evident that between the second side of the flow-conducting assembly to be cooled and the impingement grille a gap is formed whose width is defined by the distance between the second side of the flow-conducting assembly to be cooled and the impingement grille. The second medium, which serves for the cooling, flows through the openings of the impingement grille namely in a flow direction that extends approximately perpendicularly to the impingement grille and to the assembly to be cooled. By way of the gap, a discharge flow of the second medium is discharged out of the gap, which extends approximately perpendicularly to the flow of the second medium through the openings of the impingement grille. This discharge flow of the second medium out of the gap can negatively affect the flow of the second medium extending through the openings of the impingement grille, which is intended to strike the assembly to be cooled in the region of the second side of the assembly to be cooled. The effectiveness of the impingement cooling can be reduced by this. This is a disadvantage.

Starting out from this, an object of the present invention is the creation of a new type of turbomachine with improved impingement cooling.

SUMMARY OF THE INVENTION

According to the present invention, flow-conducting elements for the second medium are formed in the region of at least some of the openings which, emanating from the impingement grille, extend in the direction of the second side of the flow-conducting assembly to be cooled.

The conducting elements for the second medium ensure that the flow of the second medium conducted via the openings of the impingement grille is directed in a defined manner onto the second side of the assembly of the turbomachine to be cooled. By way of this, the impingement cooling can be improved. The risk that a discharge flow of the second medium out of the gap between the assembly to be cooled and the impingement grille negatively affects the flow of the second medium conducted via the openings can thus be effectively reduced.

Preferentially, between the second side of the flow-conducting assembly and the impingement grille a gap is formed whose width is defined by the distance between the second side of the flow-conducting assembly and the impingement grille. The flow-conducting elements for the second medium, emanating from the impingement grille, extend into the gap by as far as maximally 80% of the width of the gap and preferentially minimally 40% of the width of the gap. In particular, the flow-conducting elements for the second medium, emanating from the impingement grille, extend into the gap by as far as maximally 70% and preferentially minimally 50% of the width of the gap. Such flow-conducting elements allow a particularly effective impingement cooling of the assembly of the turbomachine to be cooled.

Preferentially, the respective flow-conducting element for the second medium covers the second medium in the region of the respective flow-conducting element before the discharge flow of the second medium out of the gap. This leads to a particularly effective cooling of the assembly of the turbomachine to be cooled by the impingement cooling.

Preferentially, the respective flow-conducting element is formed at least as a nozzle. By way of a nozzle, the flow velocity of the second medium can be increased in particular in order to render the cooling of the assembly to be cooled even more effective with the help of the impingement cooling.

BRIEF DESCRIPTION OF THE DRAWINGS

Exemplary embodiments of the invention are explained in more detail by way of the drawings in which.

DETAILED DESCRIPTION OF THE PRESENTLY PREFERRED EMBODIMENTS

The present invention relates to a turbomachine, such as for example a turbine, a compressor or a gas turbine, which besides a combustion chamber comprises a turbine. A turbomachine comprises multiple flow-conducting assemblies.

In a gas turbine, the combustion chamber for example is a flow-conducting assembly which conducts a fuel flow on a first side of a wall of the combustion chamber. Further flow-conducting assemblies of a turbomachine, such as for example a gas turbine, can be so-called cover segments, which radially outside follow moving blades of a turbine stage, for example of a high-pressure turbine stage and on a first side serve for the flow conduction of the medium to be expanded in the turbine.

Flow-conducting assemblies of a turbomachine are exposed to high temperatures in particular when the first medium to be conducted on the first side of the flow-conducting assembly has a high temperature as is the case in the region of a combustion chamber of a gas turbine or of a high-pressure turbine stage.

It is therefore known, in principle, to cool these flow-conducting assemblies on a second side located opposite the first side with a second medium, which has a second temperature that is lower than the first temperature. This cooling with the help of the second medium can be carried out via an impingement cooling.

The present invention relates to such details with the help of which the impingement cooling on a flow-conducting assembly of a turbomachine to be cooled can be improved.

Figure 2:
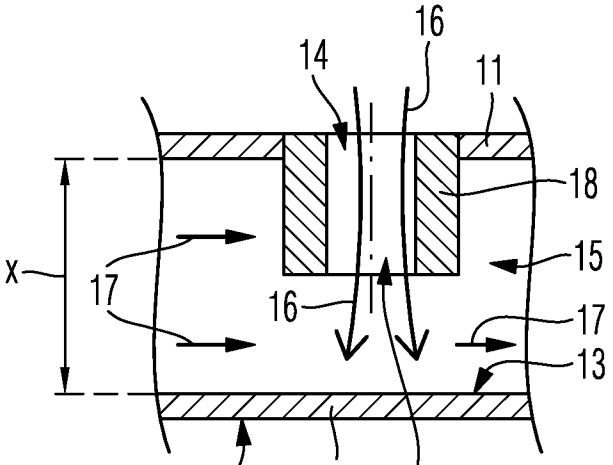
FIG. 2 shows a detail of the turbomachine in the region of a flow-conducting element.
Figure 1:
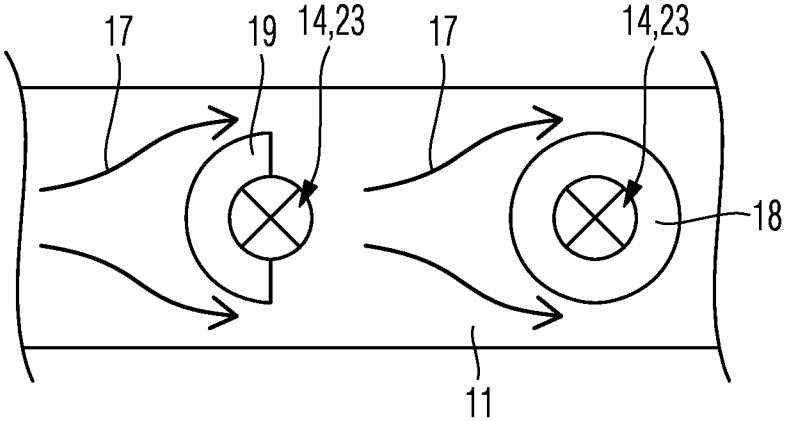
FIG. 1 shows a detail of a turbomachine in the region of a flow-conducting assembly and of an impingement grille.
Figure 3:
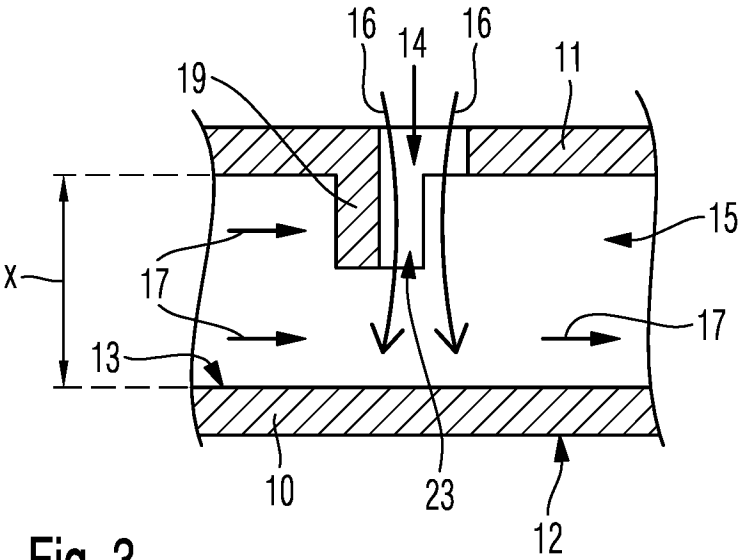
FIG. 3 shows a further detail of the turbomachine in the region of an alternative flow-conducting element.

FIGS. 1 to 3 each show extracts of a turbomachine according to the invention in the region of a flow-conducting assembly 10 to be cooled as well as in the region of an impingement grille 11. The flow-conducting assembly 10 comprises a first side 12, which serves for the flow conduction of a first medium, wherein this flow-conducting assembly 10 for example can be the wall of a combustion chamber or a cover segment of moving blades of a high-pressure turbine stage.

On a second side 13 located opposite, the flow-conducting assembly 10 is coolable with the help of a second medium which has a second temperature that is lower than the first temperature. This second medium is conducted or directed via the impingement grille 11 in the direction of the second side 13 of the flow-conducting assembly 10 to be cooled.

The impingement grille 11 comprises openings 14, wherein the second medium flows via the openings 14 of the impingement grille in the direction of the second side 13 of the assembly 10 to be cooled. Between the second side 13 of the flow-conducting 10 of the turbomachine to be cooled and the impingement grille 11 comprising the openings 14, a gap 15 is formed. The width X of the gap 15 is defined by the distance between the second side 13 of the flow-conducting assembly 10 and the impingement grille 11.

In FIGS. 2 and 3, the flow of the second medium 14 of the impingement grille 11 in the direction of the second side 13 of the flow-conducting assembly 10 to be cooled is visualised with arrows 16. Arrows 17 visualise a discharge flow of the second medium out of the gap 15.

In terms of the present invention, a flow-conducting element 18, 19 for the second medium is formed in the region of at least one of the openings 14 of the impingement grille 11, preferentially in the region of each of the openings 14 of the impingement grille 11. Emanating from the impingement grille 11, each flow-conducting element 18 or 19 extends in the direction of the second side 13 of the flow-conducting assembly 10 to be cooled into the gap 15, wherein the respective flow-conducting element 18, 19 preferentially terminates spaced from the second side 13 of the flow-conducting assembly 10.

The respective flow-conducting element 18, 19 defines, as it were, a flow-conducting passage 23 which continues the respective flow-conducting opening 14 of the impingement grille 11 in the direction of the second side 13 of the flow-conducting assembly 10 to be cooled. Each flow-conducting element 18, 19 is dimensioned in its length in particular in such a manner that the flow-conducting element 18, 19, emanating from the impingement grille 11, extends by as far as maximally 80% of the width X of the gap 15 into the gap 15, particularly preferably by as far as maximally 70% of the width X of the gap 15. The minimal length of the flow-conducting elements 18, 19 preferentially amounts to 40% of the width X of the gap 15, particularly preferably at least 50% of the width X of the gap 15.

As is evident from FIGS. 1 to 3, the flow-conducting elements 18, 19 are formed in such a manner that the flow-conducting elements 18, 19 for the second medium at least partly cover the flow of the second medium extending through the openings 14 in the region of the respective flow-conducting elements 18, 19 before the discharge flow 17 of the second medium out of the gap 15. Here, the flow-conducting elements 18, 19 can be contoured differently, the flow-conducting elements can also have different lengths, i.e. emanating from the impingement grille 11, project into the gap 15 by a different distance.

The flow-conducting element 18 of FIGS. 1, 2 is contoured circular or pipe-like in the cross section.

The flow-conducting element 19 of FIGS. 1, 3 is contoured semi-circular or half pipe-like in the cross section.

The flow-conducting elements can also be embodied part circular or elliptical or semi-elliptical or part-elliptical or spar-like or the like.

Figure 4:
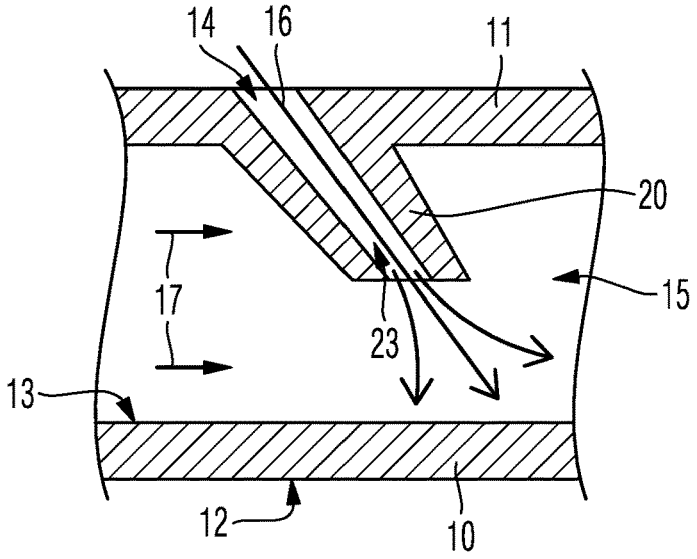
FIG. 4 shows a further alternative flow-conducting element.
Figure 5:
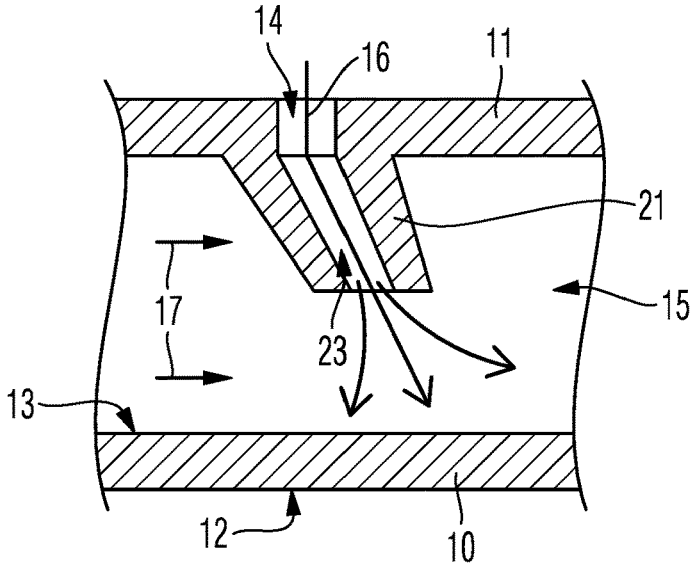
FIG. 5 shows a further alternative flow-conducting element.
Figure 6:
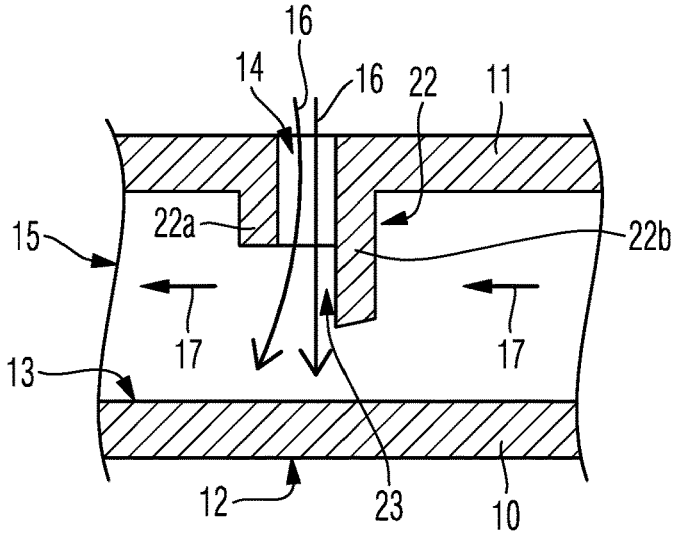
FIG. 6 shows a further alternative flow-conducting element.

FIGS. 4, 5 and 6 show further versions of possible flow-conducting elements 20, 21 and 22. The flow-conducting element 22 of FIG. 6 has a first section 22*a* that is contoured circular or pipe-like in the cross section and a second section 22*b* which is contoured semi-circular or half pipe-like in the cross section. The flow-conducting elements 18, 19 and 22 of FIGS. 1, 2, 3 and 6 each extend perpendicularly to the impingement grille 11. The flow-conducting elements 20, 21 of FIGS. 4 and 5 each extend inclined towards the impingement grille 11 relative to a perpendicular.

While in FIG. 4 the opening 14 in the impingement grille 11 is inclined and merges without any step into a flow-conducting passage 23 defined by the flow-conducting element 20, a step or a deflection is formed in FIG. 5 between the opening 14 of the impingement grille 11 and the flow-conducting passage 23 of the flow-conducting element 21.

Regarding other details of the flow-conducting elements 20, 21 and 22, preference can be made to the explanations regarding the flow-conducting elements 18, 19.

The respective flow-conducting element 18, 19, 20, 21, 22 can be formed as nozzle or receive a nozzle at least in sections. By way of the constriction of the flow-conducting element 18, 19, 20, 21, 22 to form a nozzle, the flow velocity of the flow 16 of the second medium conducted via the opening 14 of the impingement grille 11 can be increased as a result of which the impingement cooling can be rendered even more effectively. The respective flow-conducting element 18, 19, 20, 21, 22 is preferentially an integral part of the impingement grille 11 and can be constructed on the impingement grille 11 by way of an additive or generative production method. The respective flow-conducting element 18, 19, 20, 21, 22 however can also be embodied as a separate assembly and connected to the impingement grille 11.

The openings 14 of the impingement grille 11 are typically contoured circular. The invention is preferentially applied where the width X of the gap 15 between the assembly 10 to be cooled and the impingement grille 11 is greater than twice the diameter of the openings 14 of the impingement grille 11. In this application case, the invention can be particularly advantageously utilized. However, the invention is not restricted to this preferred application case.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A turbomachine, comprising a flow-conducting assembly on a first side serving for the flow-conduction of a first medium having a first temperature;

a second side coolable with a second medium having a second temperature lower than the first temperature;

an impingement grille comprising openings extending spaced from the flow-conducting assembly, wherein the openings of the impingement grille are constructed and disposed to direct the second medium onto the second side of the flow-conducting assembly; and flow-conducting elements for the second medium formed in the region of at least some of the openings, the flow-conducting elements emanating from the impingement grille extending in the direction of the second side of the flow-conducting assembly to be cooled, wherein an upstream portion of a respective flow-conducting element differs from a downstream portion of the respective flow-conducting element, wherein the upstream portion of the respective flow-conducting element is separated from the downstream portion of the respective flow-conducting element by a diameter of the respective flow-conducting element.

2. The turbomachine according to claim 1, wherein the flow-conducting elements for the second medium terminate spaced from the second side of the flow-conducting assembly.

3. The turbomachine according to claim 2, wherein between the second side of the flow-conducting assembly and the impingement grille a gap having a width is formed, the width defined by a distance between the second side of the flow-conducting assembly and the impingement grille; and wherein the flow-conducting elements for the second medium emanating from the impingement grille extend into the gap by as far as maximally 80% of the width of the gap.

4. The turbomachine according to claim 3, wherein the flow-conducting elements for the second medium emanating from the impingement grille extend into the gap by as far as maximally 70% of the width of the gap.

5. The turbomachine according to claim 3, wherein the flow-conducting elements for the second medium emanating from the impingement grille extend into the gap by as far as at least 40% of the width of the gap.

6. The turbomachine according to claim 5, wherein the flow-conducting elements for the second medium emanating from the impingement grille extend into the gap by as far as at least 50% of the width of the gap.

7. The turbomachine according to claim 1, wherein in the region of each opening a flow-conducting element for the second medium is formed.

8. The turbomachine according to claim 1, wherein the respective flow-conducting element for the second medium is embodied circular or semi-circular or part circle-like or elliptical or half-elliptical or part elliptical or spar-like in the cross section.

9. The turbomachine according to claim 1, wherein the respective flow-conducting element for the second medium covers the second medium in the region of the respective flow-conducting element before a discharge flow of the second medium out of the gap.

10. The turbomachine according to claim 1, wherein the respective flow-conducting element is formed as a nozzle at least in sections.

11. The turbomachine according to claim 1, wherein the respective flow-conducting element extends perpendicularly to the impingement grille.

12. A turbomachine, comprising:

a flow-conducting assembly on a first side serving for the flow-conduction of a first medium having a first temperature;

a second side coolable with a second medium having a second temperature lower than the first temperature;

an impingement grille comprising openings extending spaced from the flow-conducting assembly, wherein the openings of the impingement grille are constructed and disposed to direct the second medium onto the second side of the flow-conducting assembly; and flow-conducting elements for the second medium formed in the region of at least some of the openings, the flow-conducting elements emanating from the impingement grille extending in the direction of the second side of the flow-conducting assembly to be cooled, wherein at least one respective flow-conducting element is inclined towards the impingement grille relative to a perpendicular.

13. The turbomachine according to claim 4, wherein the flow-conducting elements for the second medium emanating from the impingement grille extend into the gap by as far as at least 40% of the width of the gap.

14. The turbomachine according to claim 4, wherein the flow-conducting elements for the second medium emanating from the impingement grille extend into the gap by as far as at least 50% of the width of the gap.

15. The turbomachine according to claim 1, wherein the upstream portion of the respective flow-conducting element extends further than the downstream portion of the respective flow-conducting element.

16. The turbomachine according to claim 15, wherein the upstream portion of the respective flow-conducting element is a semicircle.

17. The turbomachine according to claim 15, wherein an upstream edge of the upstream portion of the respective flow-conducting element extends further than a downstream edge of the upstream portion of the respective flow-conducting element.

* * * * *